US012674389B2

(12) United States Patent
van Zelm et al.

(10) Patent No.: US 12,674,389 B2
(45) Date of Patent: Jul. 7, 2026

(54) IN-SLIPS ACOUSTIC RECEPTION

(71) Applicant: Baker Hughes Oilfield Operations LLC, Houston, TX (US)

(72) Inventors: John-Peter van Zelm, Calgary (CA); Trevor Page, Airdrie (CA); Andrew Hawthorn, Missouri City, TX (US)

(73) Assignee: Baker Hughes Oilfield Operations LLC, Houston, TX (US)

( * ) Notice: Subject to any disclaimer, the term of this patent is extended or adjusted under 35 U.S.C. 154(b) by 110 days.

(21) Appl. No.: 18/081,080

(22) Filed: Dec. 14, 2022

(65) Prior Publication Data

US 2024/0200443 A1 Jun. 20, 2024

(51) Int. Cl.
*E21B 47/16* (2006.01)
*E21B 19/10* (2006.01)

(52) U.S. Cl.
CPC ..... *E21B 47/16* (2013.01); *E21B 19/10* (2013.01)

(58) Field of Classification Search
None
See application file for complete search history.

(56) References Cited

U.S. PATENT DOCUMENTS

2006/0219438 A1 10/2006 Moore et al.
2011/0162834 A1* 7/2011 Shah ..... G01V 1/52 166/250.01
2012/0126992 A1* 5/2012 Rodney ..... G01V 11/002 340/850
2013/0186645 A1* 7/2013 Hall ..... E21B 23/00 901/1
2018/0058209 A1* 3/2018 Song ..... G01P 5/16
2018/0283143 A1* 10/2018 Jaaskelainen ..... G01D 5/353
2019/0218908 A1 7/2019 Logan et al.
(Continued)

FOREIGN PATENT DOCUMENTS

CN 203257406 U * 10/2013

OTHER PUBLICATIONS

CN-203257406-U English Language Translation (Year: 2013).*
(Continued)

*Primary Examiner* — Steven Lim
*Assistant Examiner* — Jerold B Murphy
(74) *Attorney, Agent, or Firm* — Sprinkle IP Law Group

(57) ABSTRACT

Systems and methods that enable acoustic communications through a drill pipe even when the drill pipe is being held in floor slips. In one embodiment, multiple self-contained acoustic receivers are positioned at different locations on a drilling rig to receive acoustic telemetry signals from a downhole tool through various acoustic channels. The acoustic receivers may have components (e.g., vibration sensor, microprocessor, wireless transmitter, magnet) encased in a translucent encapsulant, which avoids exposed components that could otherwise create a spark in the hazardous drilling rig environment. Acoustic telemetry signals are communicated through the drill pipe and rig structure to the different acoustic receivers and the acoustic receivers communicate data corresponding to the received acoustic signals to a central processor that can process the signals to generate acoustic telemetry data that has a greater signal-to-noise ratio than the signals received by the individual acoustic receivers.

17 Claims, 6 Drawing Sheets

(56) References Cited

U.S. PATENT DOCUMENTS

| | | | | |
|---|---|---|---|---|
| 2021/0185419 | A1* | 6/2021 | Ye | H04R 1/083 |
| 2022/0220845 | A1* | 7/2022 | Machocki | E21B 47/13 |

OTHER PUBLICATIONS

International Search Report and Written Opinion issued by the Korean Intellectual Property Office as the International Searching Authority (KIPO/ISA) for PCT Application No. PCT/US2023/082770, mailed Apr. 17, 2024, 11 pages.

* cited by examiner

IN-SLIPS ACOUSTIC RECEPTION

BACKGROUND

Field of the Invention

The invention relates generally to the communication of data in well systems, and more particularly to systems and methods for acoustic transmission of information from downhole equipment to surface equipment when a drill pipe is in floor slips.

Related Art

Acoustic technologies are commonly used to communicate data between different pieces of equipment in a well. For example, a piece of downhole equipment which is connected to a drill pipe may generate data that needs to be communicated to equipment at the surface of the well. The piece of downhole equipment may be coupled to an acoustic transmitter which encodes the data and generates corresponding acoustic signals that are transmitted through the drill pipe to the surface of the well. An acoustic receiver Is coupled to the drill pipe at the surface of the well to receive the signals from the acoustic transmitter. The acoustic receiver decodes the acoustic signals and provides the data embodied in the acoustic signals to the well operator or to surface equipment that can process the data.

Typically, the acoustic receiver is connected to a top drive quill so that it can receive the acoustic signals that are transmitted through the drill pipe. Because the acoustic signals consist of vibrations in the drill pipe, communication of these signals from the acoustic transmitter to the acoustic receiver depends upon the ability of the drill pipe to conduct these vibrations to the receiver at the top drive. When the drill pipe is suspended from the top drive of the drilling rig, the drill pipe provides a conduction path between the acoustic transmitter and receiver which transmits the acoustic signals. However, when the drill pipe is disconnected from the top drive and is being held in floor slips, the acoustic conduction path is interrupted, and acoustic signals cannot be communicated from the downhole transmitter through the drill pipe to the receiver.

Because it is desirable to be able to communicate acoustic telemetry from the downhole equipment to the surface equipment while the drill pipe is being held by the floor slips, It would be desirable to provide means to enable acoustic communication even when the drill pipe is held in the slips. Further, it would be desirable to do so in a way that satisfies safety concerns in the hazardous environment of the drilling rig.

SUMMARY

Embodiments disclosed herein enable acoustic communications through a drill pipe even when the drill pipe is being held in floor slips. These embodiments use acoustic receivers that are coupled to one or more components of the well system that receive vibrations from the drill pipe. For example, one acoustic receiver may be secured to the floor of the drilling rig so that vibrations in the drill pipe are communicated through the floor slips to the drilling rig floor and to the acoustic receiver. Acoustic receivers may also be secured to various other parts of the drilling rig structure that are acoustically coupled to the drill pipe. If multiple acoustic receivers are used, they can be placed at different locations on the drilling rig or associated equipment so that they have different noise contributions, and the signals from the different receivers can be processed to produce a resultant signal having a greater signal-to-noise ratio than any of the signals from individual receivers.

Because the environment of the drilling rig can be very hazardous, embodiments of the acoustic receiver disclosed herein incorporate features that enable the receiver to be safely used on the drilling rig. One embodiment of the acoustic receiver has all of its electrical components completely encapsulated in a translucent polyurethane or epoxy potting compound, which is either deemed electrostatic discharge (ESD) safe or has its surface coated in an ESD dissipative material, thereby eliminating the possibility of incendive sparks being generated within an explosive atmosphere. A rare earth magnet fully encased within the encapsulant, and embedded threaded inserts provide two alternative types of couplings by which the acoustic receiver may be attached to different locations on the drilling rig. A wireless charging coil is encased within the encapsulant to charge an energy storage device such as a supercapacitor that supplies power to the electronic components of the receiver which may include, for example, an accelerometer, a microcontroller, an RF module antennae, etc.

One embodiment comprises a system for acoustically communicating downhole telemetry through a drill pipe in slips. This system includes an acoustic telemetry tool coupled to a drill pipe, a set of slips supporting the drill pipe, and at least one acoustic receiver. The acoustic telemetry tool and the drill pipe are positioned downhole in a well. The slips have interior surfaces that are configured to grip an exterior surface of the drill pipe and exterior surfaces that are conically tapered so that when the slips are positioned between the drill pipe and the support structure (e.g., floor) of a drilling rig, the drill pipe is supported by the slips and the slips are supported by the support structure. The acoustic receiver is secured to the drilling rig so that it receives acoustic signals from the acoustic telemetry tool. These signals travel through the drill pipe, the slips and the support structure of the drilling rig to the acoustic receiver.

In some cases, the drill pipe is disconnected from the top drive of the drilling rig so that the acoustic path between the downhole telemetry tool and the acoustic receiver cannot pass through the top drive. In some embodiments, the system includes an acoustic signal processor. The acoustic receiver may include a transmitter, where the acoustic receiver is configured to convert the received acoustic signals to electromagnetic signals which are transmitted to the acoustic signal processor. The acoustic signal processor is configured to analyze the received electromagnetic signals and to extract data from the acoustic telemetry tool which is embodied in the received electromagnetic signals.

In some embodiments, the acoustic receiver is one of multiple acoustic receivers that are secured to the drilling rig at different locations, where each of the acoustic receivers receive the acoustic signals through a corresponding, different acoustic channel. In some embodiments, the system also includes a hardware processor configured to receive data signals transmitted by the acoustic receivers, where each of the received data signals embody the acoustic signals from the acoustic telemetry tool. The hardware processor is configured to process the received data signals to generate a processed data signal that embodies the acoustic signals from the acoustic telemetry tool, but with a greater signal-to-noise ratio than any of the individually received data signals.

In some embodiments, the acoustic receiver includes a vibration sensor, a microcontroller, a wireless transmitter, and a magnet, all of which are fully encased within a solid encapsulant. The vibration sensor is configured to detect the acoustic signal from the downhole acoustic telemetry tool and to generate corresponding output signals. The microcontroller receives the vibration sensor output signals and generates corresponding data signals that are provided to the wireless transmitter, which transmits the data signals via a wireless channel. The magnet is positioned at one side (e.g., the bottom) of the solid encapsulant, so that magnetic fields from the magnet secure the acoustic receiver to a ferromagnetic component of the drilling rig's structure. Alternatively, the acoustic receiver may be affixed to components of the drilling rig using the threaded inserts which are embedded in the solid encapsulant. The threaded inserts are configured to receive fasteners (e.g., bolts) are thereby secure the acoustic receiver to the drilling rig.

One alternative embodiment comprises a system for acoustically communicating downhole telemetry data to surface equipment, where the system uses multiple acoustic receivers. The system has a downhole acoustic telemetry tool coupled to a drill pipe. The drill pipe may be connected to or disconnected from a top drive of the drilling rig. The acoustic receivers are secured to a drilling rig, and the acoustic receivers are coupled to receive an acoustic signal from the acoustic telemetry tool via corresponding acoustic channels through the drill pipe and structure of the drilling rig. The system also has a hardware processor that receives data signals output by the acoustic receivers, each of which embodies the acoustic signals being transmitted by the acoustic telemetry tool. The hardware processor processes the received data signals to generate a processed data signal that embodies the acoustic signals from the acoustic telemetry tool and has a greater signal-to-noise ratio than any of the individual data signals. In this system, the acoustic receivers are secured to various parts of the support structure of the drilling rig, such as the floor of the drilling rig. Each of the acoustic receivers may include a wireless transmitter that transmits data corresponding to the received acoustic signals to the hardware processor. The hardware processor may spatially filter the data signals or perform source separation processing on the data signals to generate the processed data signal.

Another alternative embodiment comprises a self-contained acoustic receiver. The acoustic receiver includes a vibration sensor, a microcontroller, a wireless transmitter, and a magnet, all of which are fully encased within a solid encapsulant. The vibration sensor is configured to detect the acoustic signal from the downhole acoustic telemetry tool and to generate corresponding output signals. The microcontroller receives the vibration sensor output signals and generates corresponding data signals that are provided to the wireless transmitter, which transmits the data signals via a wireless channel. The magnet is positioned at one side (e.g., the bottom) of the solid encapsulant, so that magnetic fields from the magnet secure the acoustic receiver to a ferromagnetic component of the drilling rig's structure. Additionally, threaded inserts may be embedded in the encapsulant to provide an alternative coupling to secure the acoustic receiver to components of the drilling rig.

In some embodiments, the acoustic receiver includes a rechargeable power source encased within the solid encapsulant, where the rechargeable power source is electrically connected to provide power to the microcontroller, wireless transmitter, vibration sensor and other internally-situated electrical devices, as required. The acoustic receiver may also have a wireless charging coil which is electrically connected to the rechargeable power source and is configured to receive electromagnetic signals and generate a corresponding charging current which is provided to recharge the rechargeable power source. The acoustic receiver may also include antennas coupled to the wireless transmitter for transmitting the data signals via the wireless channel. The acoustic receiver may also include a magnetically actuatable switch that is electrically connected to control one of the other components of the acoustic receiver (e.g., the vibration sensor, the microcontroller, the wireless transmitter, etc.). The acoustic receiver may also include visual indicators (e.g., LEDs) electrically connected to one of the components of the acoustic receiver to indicate the status or condition of the acoustic receiver. All of the electronic components of the acoustic receiver are fully encased within the solid encapsulant.

Numerous other embodiments may also be possible.

The various embodiments of the invention may provide a number of advantages over existing systems. For example, some embodiments enable the communication of acoustic telemetry from a downhole acoustic telemetry tool to equipment at the surface of a well when a drill pipe is disconnected from a top drive motor and is secured by floor slips that are wedged between the drill pipe and the floor of a drilling rig. In some embodiments, full encapsulation of the receiver makes it suitable for use in explosive atmospheres which may be present on a drilling rig. Further, the encapsulated acoustic receiver that uses a magnet for the purposes of securing the device to the drilling rig structure allows the acoustic receiver to be easily and quickly attached at various different locations on the drilling rig. Still other benefits may be apparent to those skilled in the art. Other advantages may also be apparent to those of skill in the art.

BRIEF DESCRIPTION OF THE DRAWINGS

Other objects and advantages of the invention may become apparent upon reading the following detailed description and upon reference to the accompanying drawings.

Figure 1:
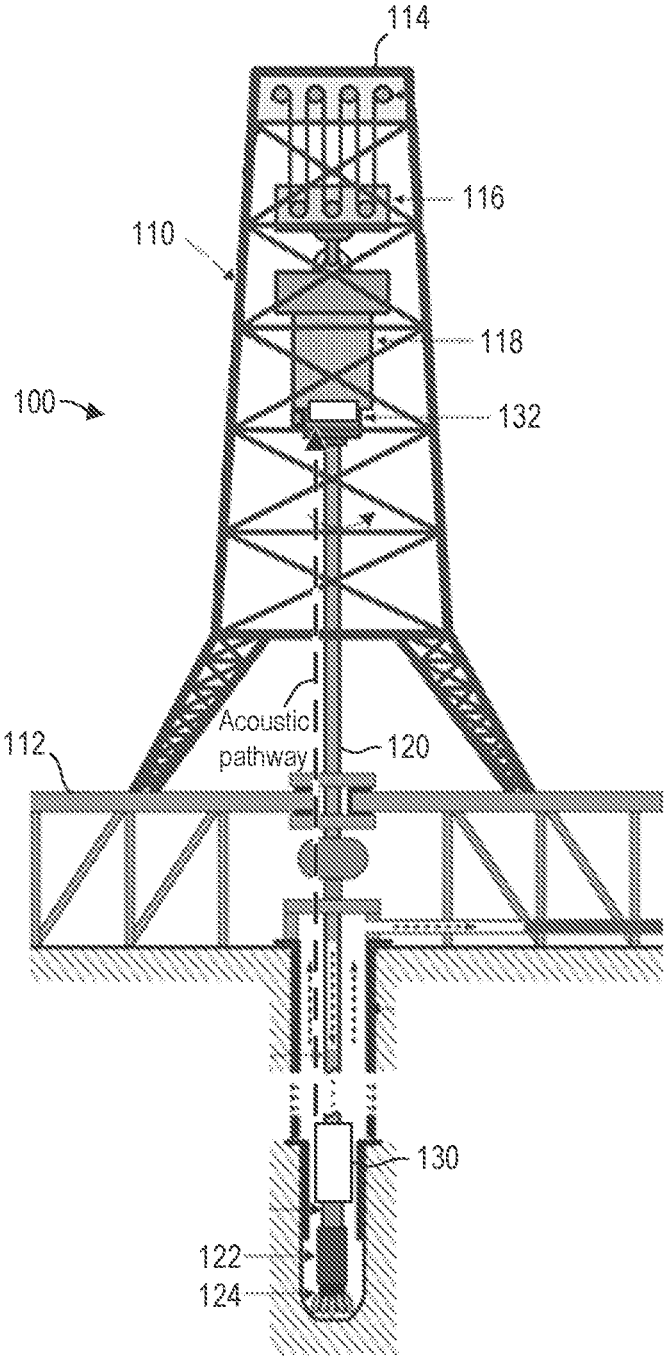
(prior art) FIG. 1
FIG. 1 is a diagram illustrating a conventional acoustic communication system.

While the invention is subject to various modifications and alternative forms, specific embodiments thereof are shown by way of example in the drawings and the accompanying detailed description. It should be understood, however, that the drawings and detailed description are not intended to limit the invention to the particular embodiment which is described. This disclosure is instead intended to cover all modifications, equivalents and alternatives falling within the scope of the present invention as defined by the appended claims.

DETAILED DESCRIPTION OF EXEMPLARY EMBODIMENTS

One or more embodiments of the invention are described below. It should be noted that these and any other embodiments described below are exemplary and are intended to be illustrative of the invention rather than limiting.

Embodiments of the acoustic communication systems and methods disclosed herein enable acoustic telemetry through a communication path that includes a drill pipe that is secured by floor slips in a drilling rig. In these embodiments, one or more acoustic receivers are secured to the structure of the drilling rig (e.g., the floor of the rig). The receiver(s) sense vibrations (acoustic signals) that are conveyed from the drill pipe through the slips to the floor and structure of the drilling rig. If multiple acoustic receivers are used, the acoustic signals received by each of the array of receivers can be processed to reduce the noise in the combined signals. The individual acoustic receivers may utilize the self-contained, inherently safe designs disclosed herein which can be safely employed in the hazardous environment of the drilling rig.

Before describing the embodiments of the invention, it may be helpful to review a conventional acoustic communication system and the problem that arises when the drill pipe is in floor slips.

Referring to FIG. 1, a diagram is shown to illustrate a conventional acoustic communication system. In this system, a drilling rig 100 includes a derrick 110 which is secured to a drilling rig floor 112. Derrick 110 supports a crown block 114 which is coupled to a traveling block 116 which is raised and lowered by a set of pulleys. Traveling block 116 supports a top drive drilling motor 118 which is coupled to a drill pipe string 120. Drill pipe string 120 extends through floor 112 of the drilling rig and into the borehole of a well. The lower end of drill pipe string 120 is coupled to a set of collars 122 and a drilling tool 124.

Also coupled to the lower end of drill pipe string 120 is acoustic telemetry tool 130. Acoustic telemetry tool 130 is configured to encode data in acoustic signals and to transmit these acoustic signals through drill pipe string 120. The acoustic signals travel upward through drill pipe string 120 and are received by acoustic receiver 132 which is secured to the upper end of the drill pipe string. Acoustic receiver 132 decodes the data from the received acoustic signals and provides this data to equipment that can be used by the well operator to view or process the data, control the well, etc. The data may be communicated to the other equipment in any suitable manner, but commonly by a wireless communication link.

When drill pipe string 120 is engaged by top drive motor 118, the drill pipe string forms an acoustic communication pathway from acoustic telemetry tool 132 to acoustic receiver 132. When the drill pipe string is disconnected from the top drive motor and is held by floor slips, this acoustic communication pathway is interrupted, so the acoustic telemetry tool can no longer communicate with the acoustic receiver through the drill pipe string. This is illustrated in FIG. 2.

Figure 2:
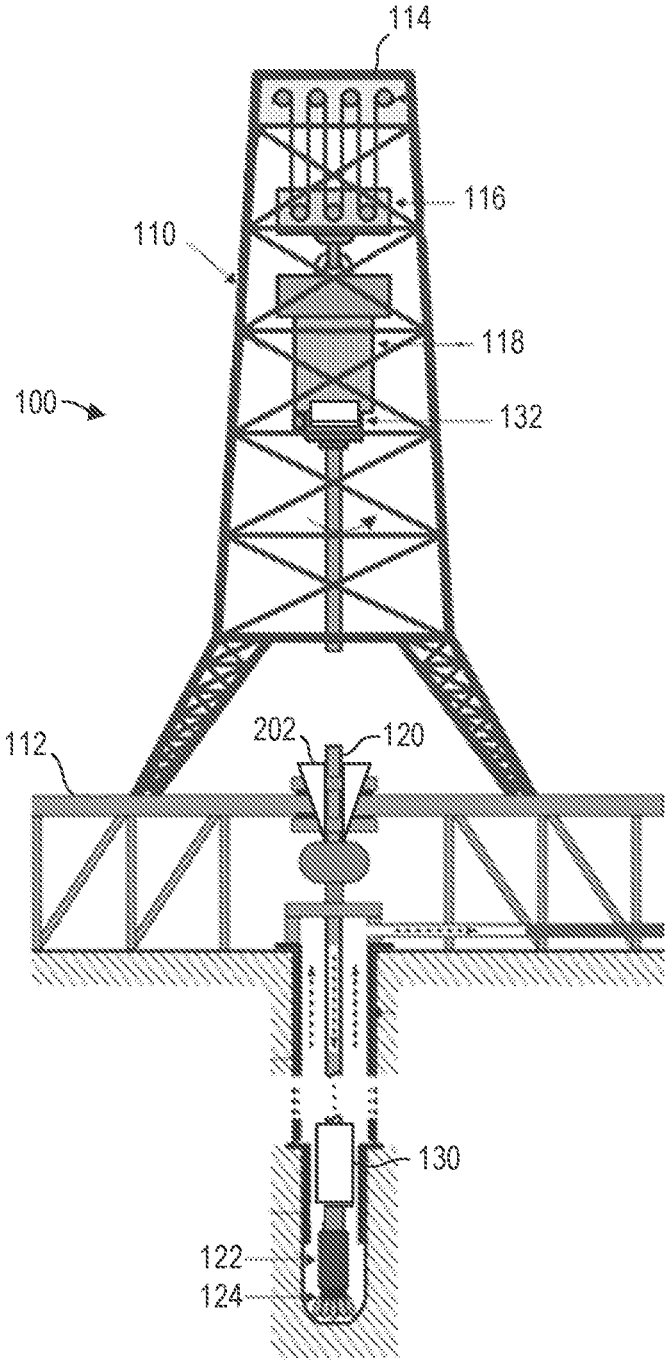
(prior art) FIG. 2
FIG. 2 is a diagram illustrating the conventional acoustic communication system of FIG. 1, but with the drill pipe disconnected from the top drive motor.

Referring to FIG. 2, the same drilling system is shown as in FIG. 1, but the drill pipe string 120 has been disconnected from top drive motor 118. Drill pipe string 120 is instead held in place by floor slips 202, which are wedged between the drill pipe string and floor 112 of the drilling rig. Since drill pipe string 120 has been disconnected from top drive motor 118, vibrations in the drill pipe string cannot reach acoustic receiver 132 which is mounted at the top drive motor. Consequently, this conventional acoustic telemetry system cannot operate when the drill pipe is disconnected and held by the floor slips.

It should be noted that there may be valuable information that could be obtained to monitor downhole conditions when the drill pipe is in the floor slips. For example, downhole pressure in the well can be monitored during top drive maintenance or other surface operations, survey information can be relayed to the surface while pipe connections are made, etc.

Embodiments disclosed herein therefore make use of acoustic transmission paths that are not interrupted when the drill pipe is secured by the floor slips. One or more acoustic receivers are secured to components of the drilling system which maintain paths for acoustic communication with the downhole acoustic telemetry tool through the floor slips. This is illustrated in FIG. 3.

Figure 3:
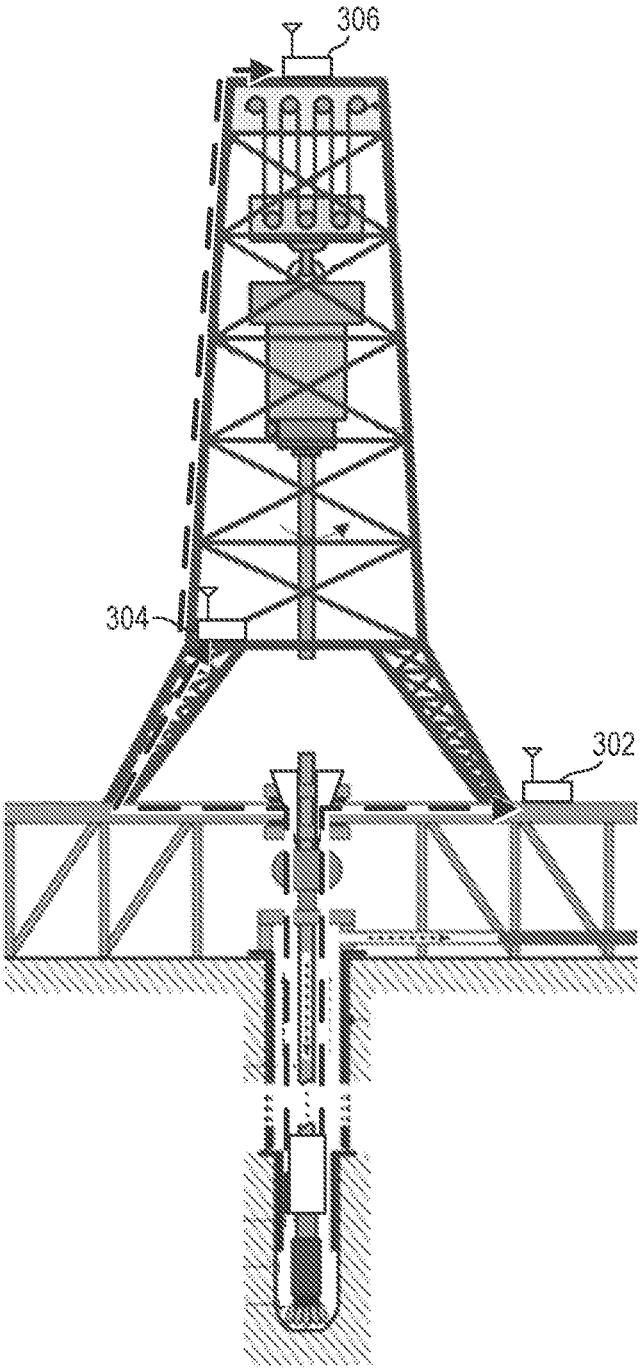
FIG. 3 is a diagram illustrating a system that enables acoustic communication through the floor slips in accordance with some embodiments.

Referring to FIG. 3, a diagram is shown to illustrate a system that enables acoustic communication through the floor slips in accordance with some embodiments. The drilling rig in this embodiment is the same as the rig in FIGS. 1 and 2, with rig floor 112 supporting the derrick 110. At the top of derrick 110, crown block 114 supports a traveling block 116, which in turn supports the top drive motor 118. At the floor 112 of the drilling rig, slips 202 are wedged between the floor and drill pipe string 120 to support the drill pipe string.

In this example, the system does not have an acoustic receiver mounted at the top drive motor 118. Instead, the system has a set of acoustic receivers that are secured to the structure of the drilling rig. This embodiment includes a first acoustic receiver 302 secured to floor 112 of the drilling rig, a second acoustic receiver 304 secured to derrick 110, and a third acoustic receiver 306 secured to crown block 114 at the top of the derrick.

When acoustic telemetry tool 130 generates an acoustic signal, the corresponding vibrations are conveyed from the tool through drill pipe 120. Because drill pipe 120 is held by slips 202 which are wedged between the drill pipe and rig floor 112 the vibrations of the acoustic signal are transmitted through the slips to the rig floor. Acoustic receiver 302, which is secured to rig floor 112, therefore receives the acoustic signal. Acoustic receiver 302 can therefore decode the signal and transmit the decoded data via a wireless link to the appropriate surface equipment. Although other types of communication links (e.g., a wired link) could be used in alternative embodiments, the wireless link is well suited to the hazardous environment at the rig floor.

Similar to acoustic receiver 302, acoustic receiver 304 receives an acoustic signal which is transmitted from telemetry tool 130 through drill pipe 120 and rig floor 112. The acoustic signal is also transmitted through the lower structure of derrick 110 before reaching acoustic receiver 304. The received acoustic signal is decoded, and the corresponding data is transmitted from the acoustic receiver via a corresponding communication link to the surface equipment that will consume (e.g., process, store, forward, etc.) the data. Acoustic receiver 306 likewise receives and acoustic signal which is transmitted through drill pipe 120, rig floor 112 and derrick 110, finally reaching the receiver which is positioned at crown block 114. Acoustic receiver 306 also decodes the received acoustic signal and transmits the data via a corresponding communication link to the appropriate surface equipment.

While the embodiment of FIG. 3 uses three acoustic receivers to sense acoustic signals transmitted through the drill pipe string, floor slips and rig floor, other embodiments may use more acoustic receivers or less (e.g., one) acoustic receivers.

Figure 4A:
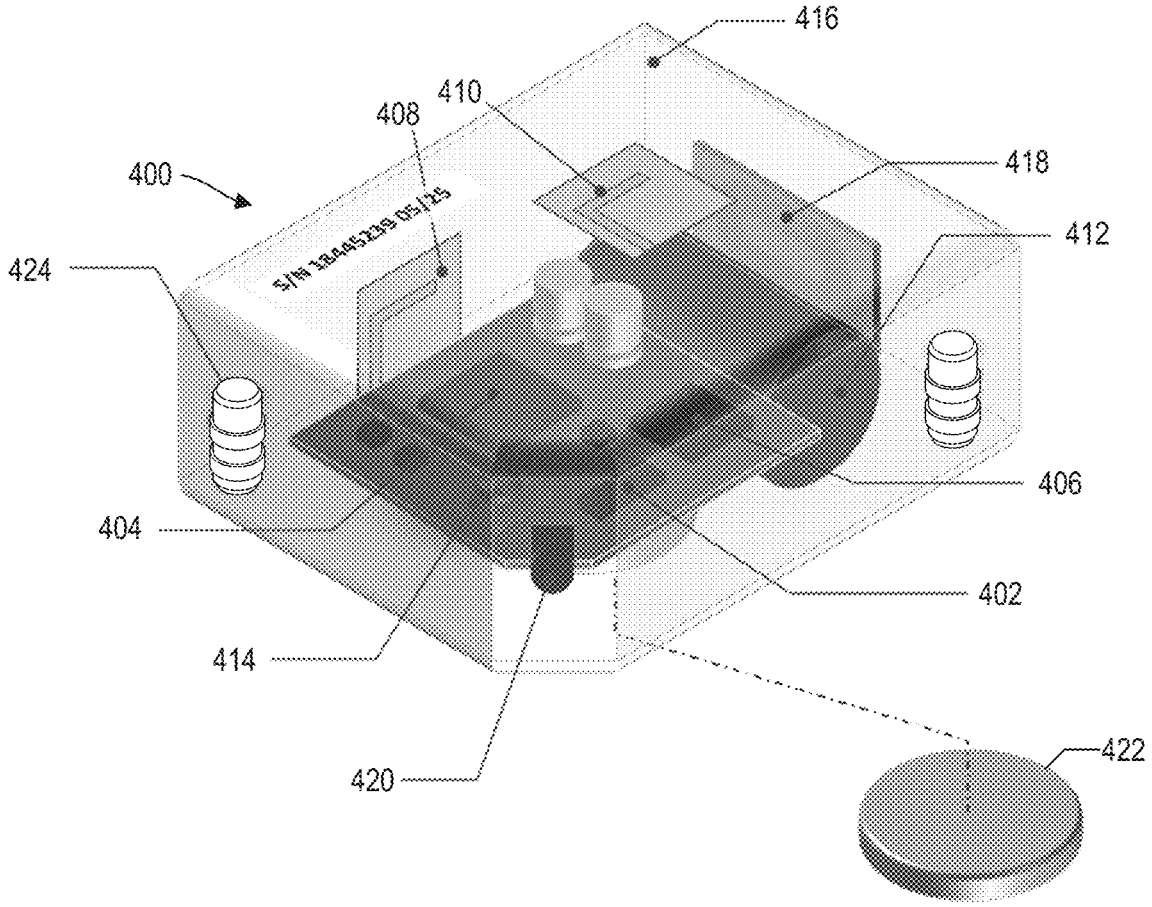
FIG. 4A is a diagram illustrating an example of a self-contained acoustic receiver in accordance with some embodiments.

The acoustic communication system may use various different types of receivers. Referring to FIG. 4A, an example of a self-contained acoustic receiver which is well suited for use on a drilling rig is shown. Acoustic receiver 400 includes a number of components which are typically found in an acoustic receiver. For example, the device includes a 3-axis accelerometer or other vibration sensor 402 which is used to detect the vibrations that are communicated by the acoustic telemetry tool. The output of the accelerometer is provided to a microcontroller 404 which may process the data and generate signals to be transmitted to other surface equipment. An RF module 406 (e.g., a low power Bluetooth module) may receive signals from microcontroller 404 to generate RF signals for wireless transmission to the other surface equipment. Antennas 408 and 410 are provided to transmit and receive wireless signals. A power supply 412 (which in this case may be a supercapacitor) provides DC power to the accelerometer, microcontroller and RF module. A power/status indicator 414 may be provided to generate visual indications of the device status (e.g., power on/off, etc.).

Because the acoustic receiver must be suitable for the hazardous environment of the drilling rig floor, there are a number of features that should be incorporated into the design of the device. For example, the acoustic receiver should be compact so that it does not get in the way or interfere with operations on the drilling rig. It should reduce Health, Safety and Environmental (HSE) risks such as presenting a tripping hazard. Because of the likely presence of combustible materials (i.e., hydrocarbons) on the drilling rig, the acoustic receiver should be rated for operations in explosive atmospheres. Further, it would be beneficial for the acoustic receivers to be easily and quickly installed and removed.

Acoustic receiver 400 provides these features in part by embedding the components of the receiver in a polyurethane or epoxy encapsulant 416 which effectively serves as a housing. The encapsulant may be transparent or translucent to allow the internal components to be visible. Because the components of the device are sealed within the encapsulant, there is no danger of the internal electrical components creating incendive sparks within the potentially explosive external atmosphere. To eliminate the possibility of incendive sparks being generated by electrostatic discharge, the encapsulant should either be of a dissipative ESD-safe variety, or have a static dissipative coating applied to the external surfaces of the encapsulant. Further, by encapsulating the components in polyurethane or epoxy, thereby eliminating the need for an outer metal housing, frame or enclosure, the possibility of incendive sparks being generated from a percussive strike against and external object is also eliminated.

Because power source 412 (in this case a supercapacitor) is embedded in the encapsulant, it is necessary to provide a wireless charging coil 418 (which is also embedded in the encapsulant) to allow the supercapacitor to be recharged without having an exposed physical electrical contact. Additionally, because it is desirable to avoid having an external switch, this embodiment uses a Hall effect magnetic sensor 420 as a switch. The Hall effect sensor is also fully embedded within the polyurethane or epoxy so that it is not exposed. The sensor can be actuated to perform functions such as powering the device on, powering the device off, initiating a factory reset, etc., using a magnet which is passed by the sensor.

Acoustic receiver 400 also includes a high strength magnet 422 which is fully encased within the encapsulant at the bottom of the device. Magnet 422 allows the acoustic receiver to be secured to any suitable (typically flat) ferromagnetic metal surface, such as the drilling rig floor. Since the magnet is fully embedded in the encapsulant, it does not present an exposed metal surface which could cause a spark in the hazardous drilling rig environment. Magnet 422 also allows the acoustic receiver to be quickly and easily installed and removed, and does not require any special mounting hardware or tools.

Acoustic receiver 400 may additionally or alternatively include threaded inserts 424, embedded in the encapsulant, to provide a further method of securement, should a suitably-flat ferromagnetic surface be unavailable, or a more permanent or secure method of mounting be desired.

As noted above, the present embodiments may use one or more acoustic sensors that are positioned to receive acoustic signals through the rig floor and related structures of the drilling rig when the drill pipe string is in floor slips. It may be desirable to use multiple acoustic receivers in order to sense the acoustic signal transmitted from the downhole acoustic tool at different positions on the drilling rig. The respective signals sensed by each of these acoustic receivers will be slightly different because the acoustic telemetry signal may pass through different acoustic pathways, and may include noise from different sources within the drilling system. Each combination of an acoustic pathway and the corresponding noise received by a particular acoustic receiver may be referred to as an acoustic channel.

The different acoustic channels received by each of the different acoustic receivers can be processed to improve or enhance the acoustic telemetry signal relative to the noise. The processing of the acoustic channels may use various different multi-sensor techniques, such as noise cancellation and diversity (e.g., switching, combining MRC, equal gain, etc.), and may also use array techniques such as beam forming and source separation. The specific techniques that may be used are not important to the embodiments disclosed herein, so these techniques will not be described in detail in this disclosure.

Figure 4B:
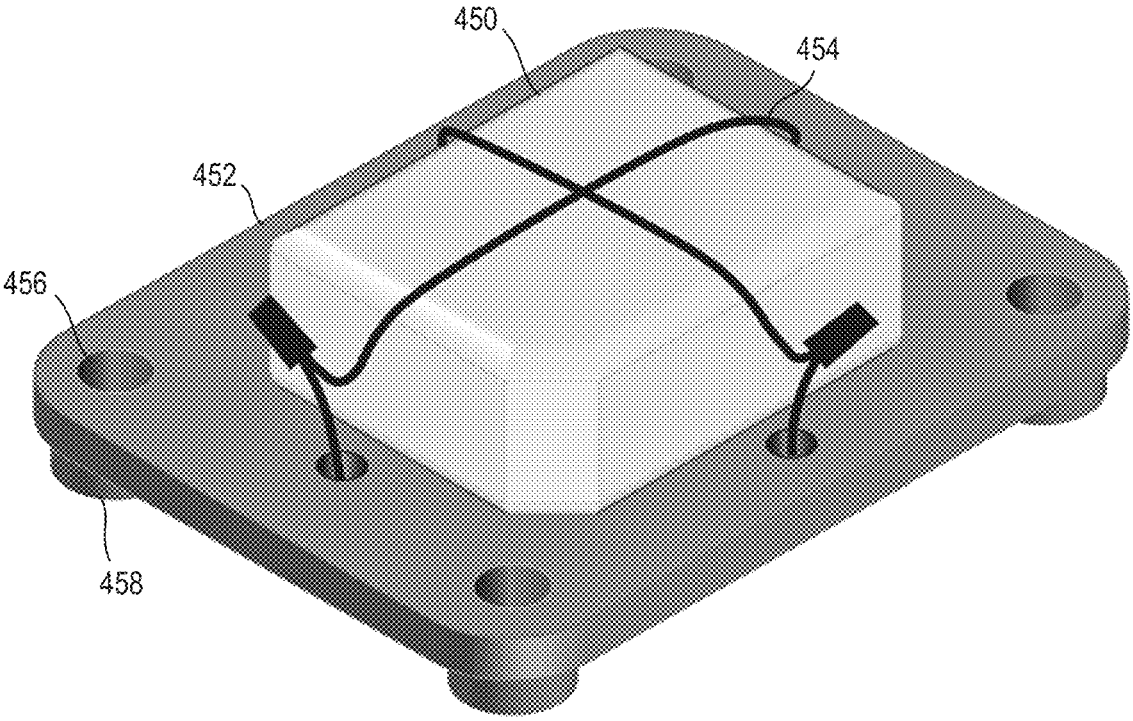
FIG. 4B is a diagram illustrating an example of an alternative mounting for a self-contained acoustic receiver in accordance with some embodiments.

Referring to FIG. 4B, a diagram illustrating an example of an alternative mounting for a self-contained acoustic receiver in accordance with some embodiments. As depicted in this figure, an acoustic receiver 450 is secured to a mounting plate 452 by two crimped-loops (e.g., 454) of aircraft wire. The acoustic receiver may be primarily secured to the mounting plate by threaded inserts as described above, and/or by a magnet encased in the encapsulant of the receiver if the mounting plate is ferrous. The mounting plate includes outer holes (e.g., 456) for bolts in order to provide a means to robustly mount the whole assembly to components of the drilling rig. The bolts themselves can be retained with castle nuts and cotter pins. Mounting plate could alternatively be secured to the drilling rig with clamps or other means. Bosses (e.g., 458) are provided on the underside of the plate are to provide clearance for the underlying aircraft wire and heads of the bolts which are screwed into the acoustic receiver's threaded inserts.

Figure 5:
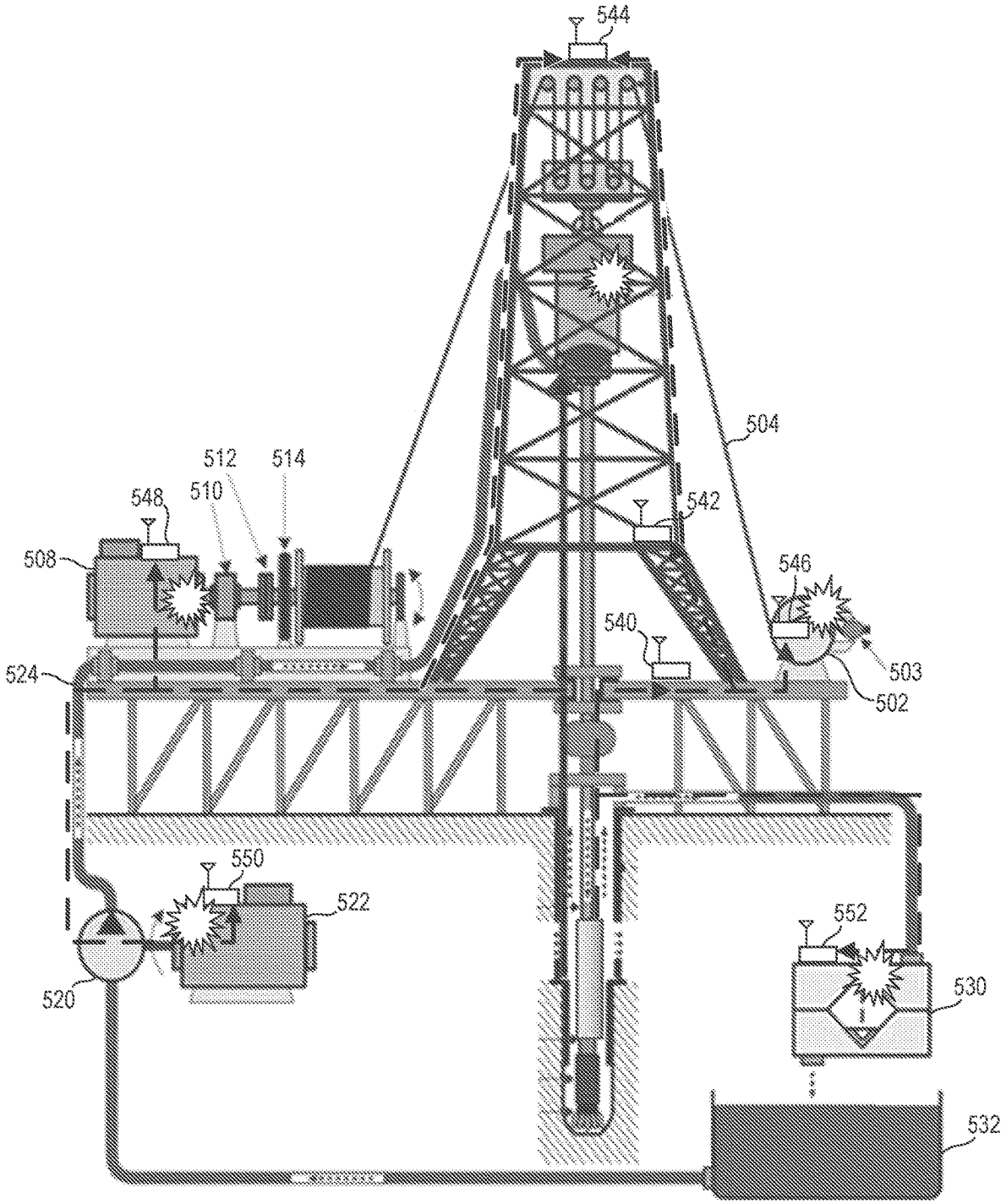
FIG. 5 is a diagram illustrating embodiment of an acoustic communication system that uses multiple acoustic receivers in accordance with some embodiments.

Referring to FIG. 5, a diagram is shown to illustrate one embodiment of the present acoustic communication system that uses multiple acoustic receivers. FIG. 5 depicts the same drilling rig structure as in FIGS. 1-3, but shows some additional components of the drilling system. For example, this figure shows the hoist cable dead end anchor 502 (with hook load sensor 503) which secures one end of the cable 504 that runs through the pulleys on crown block 114 and traveling block 116. The other end of cable 504 is wound on draw-works drum 506. Drum 506 is coupled to a motor 508 which drives the drum to wind or unwind the cable, causing traveling block 116 to move upward or downward on the derrick. Voter 508 is coupled to drum 506 through a transmission 510 and a coupling 512. A brake 514 provides braking on drum 506.

FIG. 5 Also shows components of the drilling system that are used to circulate drilling mud through the drill pipe string and the well. These include drilling mud pump 520 and its motor 522, a drilling mud pipeline 524 which conveys drilling mud to the top of the drill pipe string, a second pipeline 526 which carries drilling mud from the borehole to drilling cuttings separator 530 and a drilling mud pit 532 from which drilling mud is provided to drilling mud pump 520.

These additional components of the drilling system are shown to illustrate various sources of noise that may be present in the system. The noise is indicated by the star-shaped icons in the figure. These icons indicate that components such as the top drive motor 118, hoist cable anchor 502, draw-works drum motor 508, drilling mud pump motor 522 and drilling cuttings separator 530, all of which may be sources of noise with respect to the acoustic telemetry signal.

It can be seen in FIG. 5 that some of the acoustic receivers in this embodiment are positioned on the drilling rig structure away from these noise sources, while others are closer to the noise sources. For example, in this embodiment, acoustic receiver 540 is secured to the floor of the drilling rig, an acoustic receiver 542 is secured above a leg of the derrick, and acoustic receiver 544 is secured to the crown block at the top of the derrick. Each of these acoustic receivers is on an acoustic path that carries the acoustic telemetry signal from the acoustic telemetry tool downhole in the well.

When the drill pipe is connected to the top drive and there are no floor slips wedged between the drill pipe and the rig floor, the acoustic telemetry signal may travel primarily through the drill pipe and the top drive to acoustic receiver 544 at the crown block. The acoustic telemetry signal may be carried less strongly through the other parts of the structure to acoustic receivers 540, 542 and 544.

When the drill pipe is disconnected from the top drive and the floor slips are wedged between the drill pipe and the rig floor in order to secure the drill pipe, the acoustic telemetry signal will travel primarily through the rig floor and the derrick structure to acoustic receivers 540, 542 and 544.

In addition to acoustic receivers 540, 542 and 544, the system includes multiple acoustic receivers which are positioned closer to various noise sources that are present in the system. For example, acoustic receiver 546 is positioned near hoist cable dead-end anchor 502, acoustic receiver 548 is positioned near draw-works motor 508, acoustic receiver 550 is positioned near drilling mud pump motor 522, and acoustic receiver 552 is positioned near drilling cuttings separator 530.

If a single acoustic receiver is used to detect the acoustic telemetry signal from the downhole acoustic telemetry tool, it is desirable to position the acoustic receiver in a location that is optimized for collecting acoustic signals from the various acoustic channels (pathways) between the down hole tool and the receiver. Each of these channels may have a different acoustic response and may be subject to different noise sources.

When multiple acoustic receivers are used to detect the acoustic telemetry signal from the downhole acoustic telemetry tool, the different acoustic signals received by the various acoustic receivers can be processed in a number of ways and combined to produce a resultant acoustic telemetry signal having a higher signal-to-noise ratio than the different, individually-received signals. The signals received by the different acoustic receivers may for example, be processed by a spatial filtering system such as a delay-and-sum beamformer or a filter-and-sum beamformer.

A delay-and-sum beamformer is a processor that works on discretely sampled spatial data from an array of sensors. This processor individually delays signals from different sensors (in this case from acoustic receivers) to synchronize them, after which they are coherently summed to reinforce the primary intended signal while reducing noise and other undesirable, incoherent signals. The gain in the signal-to-noise ratio is generally proportional to the number of sensor signals that are summed and the degree of spatial decorrelation of the noise and other non-primary signals. Commonly, an array of regularly-spaced sensors is used, and a gain lobe is formed which is directed at the primary signal to improve the signal-to-noise ratio.

A filter-and-sum beamformer is a processor that adds weights which create nulls that can be directed toward noise or other undesired acoustic sources. For instance, spatial weights (e.g., a single tap filter) may be used to create nulls at a particular frequency, or a temporal filter may be added to each spatial sensor to create spatial nulls at multiple frequencies. It may also be possible to compensate for channel distortion.

Alternatively, a source separation approach may be used to reduce noise and interference with respect to the acoustic telemetry signal. When using this approach, the component signals from the various independent sources of noise and interference are estimated from the observed sensor data set. This approach does not require a priori knowledge of the geometry of the sensor array or the noise and interference sources, and is not impacted by mobility of the noise and interference sources. Further, it is not dependent on spatial-temporal correlation properties.

It should be noted that, while the use of multiple acoustic receivers is important in in the context of several of the embodiments disclosed herein, the particular techniques that may be used to process the data generated by these acoustic receivers are not important to the invention, so they will not be discussed here in further detail.

The various embodiments of the invention may provide a number of advantages over existing systems and methods. For instance, some embodiments enable the communication of acoustic telemetry from a downhole acoustic telemetry tool to equipment at the surface of a well when a drill pipe is disconnected from a top drive motor and is secured by floor slips that are wedged between the drill pipe and the floor of a drilling rig. In some embodiments, full encapsulation of the receiver makes it suitable for use in explosive atmospheres which may be present on a drilling rig. Further, the encapsulated acoustic receiver that uses a magnet for purposes of securing the device to the drilling rig structure allows the acoustic receiver to be easily and quickly attached at various different locations on the drilling rig. Still other benefits may be apparent to those skilled in the art.

The benefits and advantages which may be provided by the present invention have been described above with regard to specific embodiments. These benefits and advantages, and any elements or limitations that may cause them to occur or to become more pronounced are not to be construed as critical, required, or essential features of any or all of the described embodiments. As used herein, the terms "comprises", "comprising", or any other variations thereof, are intended to be interpreted as non-exclusively including the elements or limitations which follow those terms. Accordingly, a system, method, or other embodiment that comprises a set of elements is not limited to only those elements, and may include other elements not expressly listed or inherent to the described embodiment.

While the present invention has been described with reference to particular embodiments, it should be understood that the embodiments are illustrative and that the scope of the invention is not limited to these embodiments. Many variations, modifications, additions and improvements to the embodiments described above are possible. It is contemplated that these variations, modifications, additions and improvements fall within the scope of the invention as detailed by the claims of the application.

What is claimed is:

1. A system for acoustically communicating downhole telemetry through a drill pipe in slips, the system comprising:

an acoustic telemetry tool coupled to a drill pipe, the acoustic telemetry tool and the drill pipe positioned downhole in a well;

a set of slips having interior surfaces configured to grip an exterior surface of the drill pipe and exterior surfaces that are conically tapered, wherein when the slips are positioned around the drill pipe between the drill pipe and a support structure of a drilling rig, the drill pipe is supported by the slips and the slips are supported by the support structure;

a plurality of acoustic receivers, each of the plurality of acoustic receivers mounted on the drilling rig at different locations, wherein the plurality of acoustic receivers are acoustically coupled to receive acoustic signals through a different, corresponding acoustic channel from the acoustic telemetry tool through the drill pipe, the slips and the support structure of the drilling rig; and a hardware processor configured to receive data signals transmitted by the plurality of acoustic receivers, each of the received data signals embodying the acoustic signals being transmitted by the acoustic telemetry tool, wherein the hardware processor is configured to process the received data signals to generate acoustic telemetry data with a higher signal-to-noise ratio than data signals received by the individual acoustic receivers.

2. The system of claim 1, wherein the drill pipe is disconnected from a top drive of the drilling rig.

3. The system of claim 1, wherein each acoustic receiver includes a transmitter configured to convert the received acoustic signals to electromagnetic signals and to transmit the electromagnetic signals to the hardware processor, wherein the hardware processor is configured to analyze the received electromagnetic signals and to extract data from the acoustic telemetry tool which is embodied in the received electromagnetic signals.

4. The system of claim 1, wherein each of the plurality of acoustic receivers comprises:

a vibration sensor configured to detect an acoustic signal and to generate corresponding output signals;

a microcontroller configured to receive the vibration sensor output signals and generate corresponding data signals;

a wireless transmitter configured to receive the data signals generated by the microcontroller and transmit the data signals via a wireless channel; and threaded inserts;

wherein the vibration sensor, the microcontroller, and the wireless transmitter are fully encased within a solid encapsulant, and wherein the threaded inserts are positioned at a side of the solid encapsulant, wherein the threaded inserts are embedded in the encapsulant and are capable of securing the acoustic receiver to the drilling rig.

5. The system of claim 1, wherein each of the plurality of acoustic receivers comprises:

a vibration sensor configured to detect an acoustic signal and to generate corresponding output signals;

a microcontroller configured to receive the vibration sensor output signals and generate corresponding data signals;

a wireless transmitter configured to receive the data signals generated by the microcontroller and transmit the data signals via a wireless channel; and a magnet;

wherein the vibration sensor, the microcontroller, the wireless transmitter, and the magnet are fully encased within a solid encapsulant, the magnet positioned at a side of the solid encapsulant, wherein magnetic fields from the magnet are capable of securing the acoustic receiver to a ferromagnetic structure.

6. A system for acoustically communicating downhole telemetry to surface equipment, the system comprising:

an acoustic telemetry tool coupled to a drill pipe, the acoustic telemetry tool and the drill pipe positioned downhole in a well;

a plurality of acoustic receivers, wherein each of the plurality of acoustic receivers is mounted on a drilling rig at different locations, wherein each of the plurality of acoustic receivers is acoustically coupled to receive an acoustic signal from the acoustic telemetry tool via different, corresponding acoustic channels through the drill pipe, a support structure of the drilling rig, and a set of slips supported by the support structure and configured to grip the drill pipe; and a hardware processor configured to receive data signals output by corresponding ones of the acoustic receivers, each of the received data signals embodying the acoustic signals transmitted by the acoustic telemetry tool, the hardware processor configured to process the received data signals to generate a processed data signal that embodies the acoustic signals from the acoustic telemetry tool with a higher signal-to-noise ratio than the data signals received by the individual acoustic receivers.

7. The system of claim 6, wherein the hardware processor is configured to perform source separation processing on the data signals to generate the processed data signal.

8. The system of claim 6, wherein the hardware processor is configured to spatially filter the data signals to generate the processed data signal.

9. The system of claim 6, wherein the drill pipe is disconnected from a top drive of the drilling rig.

10. The system of claim 6, wherein the drill pipe is connected to a top drive of the drilling rig.

11. The system of claim 6, wherein the support structure of the drilling rig comprises a floor of the drilling rig.

12. The system of claim 6, wherein each of the plurality of acoustic receivers includes a wireless transmitter configured to convert the received acoustic signals to the corresponding data signals and to wirelessly transmit the data signals to the hardware processor.

13. A self-contained acoustic receiver comprising:

a vibration sensor configured to detect an acoustic signal and to generate corresponding output signals;

a microcontroller configured to receive the vibration sensor output signals and generate corresponding data signals;

a wireless transmitter configured to receive the data signals generated by the microcontroller and transmit the data signals via a wireless channel; and one or more visual indicators electrically connected to at least one of the vibration sensor, the microcontroller and the wireless transmitter, the one or more visual indicators encased within a solid encapsulant, wherein the solid encapsulant is translucent;

a coupling;

wherein the vibration sensor, the microcontroller, the wireless transmitter and the coupling are encased within the solid encapsulant which is electrostatic discharge (ESD) safe, and wherein the coupling is configured to secure the acoustic receiver to the drilling rig.

14. The acoustic receiver of claim 13, further comprising at least one magnetically actuatable switch electrically connected to control at least one of the vibration sensor, the microcontroller and the wireless transmitter, the at least one magnetically actuatable switch encased within the solid encapsulant.

15. The acoustic receiver of claim 13, further comprising one or more antennae coupled to the wireless transmitter and configured to transmit the data signals via the wireless channel, the one or more antennae encased within the solid encapsulant.

16. The acoustic receiver of claim 13, wherein the coupling comprises at least one of:

a magnet positioned at a side of the solid encapsulant, wherein magnetic fields from the magnet are capable of securing the acoustic receiver to a ferromagnetic structure; and threaded inserts which are positioned at a side of the solid encapsulant, wherein the threaded inserts are configured to receive threaded fasteners and are thereby capable of securing the acoustic receiver to the drilling rig.

17. The acoustic receiver of claim 13, further comprising:

a rechargeable power source encased within the solid encapsulant, the rechargeable power source electrically connected to provide power to one or more of the vibration sensor, microcontroller and wireless transmitter; and a wireless charging coil electrically connected to the rechargeable power source, the wireless charging coil configured to receive electromagnetic signals and generate a corresponding charging current which is provided to the rechargeable power source.

* * * * *